United States Patent [19]

Riggs

[11] 3,961,888

[45] June 8, 1976

[54] ACRYLIC FIBER CONVERSION UTILIZING A STABILIZATION TREATMENT CONDUCTED INITIALLY IN AN ESSENTIALLY INERT ATMOSPHERE

[75] Inventor: John P. Riggs, Berkeley Heights, N.J.

[73] Assignee: Celanese Corporation, New York, N.Y.

[22] Filed: Sept. 18, 1968

[21] Appl. No.: 760,658

[52] U.S. Cl. ..... 8/115.5; 423/447

[51] Int. Cl.[2] ..... D06M 3/26; C01B 31/07

[58] Field of Search ..... 23/209.1, 209.2, 209.4; 8/115.5; 423/447; 264/29

[56] References Cited

UNITED STATES PATENTS

| | | | |
|---|---|---|---|
| 3,285,696 | 11/1966 | Tsunoda | 23/209.1 |
| 3,412,062 | 11/1968 | Johnson et al. | 23/209.1 X |
| 3,533,743 | 10/1970 | Prescott et al. | 423/447 |
| 3,539,295 | 11/1970 | Ram | 423/447 |
| 3,552,923 | 1/1971 | Carpenter et al. | 423/447 |

OTHER PUBLICATIONS

Vosburgh, "Textile Research Journal", vol. 30, 1960, pp. 882–896.

*Primary Examiner*—Edward J. Meros

[57] ABSTRACT

A process is provided for the stabilization of a fibrous material composed of an acrylic polymer, e.g. an acrylonitrile homopolymer or a closely related copolymer. The fibrous material is subjected to a multiple stage stabilization treatment in which the initial stage is conducted in an essentially inert atmosphere, and a subsequent stage in an atmosphere containing an appreciable quantity of oxygen. The initial treatment which is conducted in a relatively inert atmosphere is believed to result in an improved cyclized molecular structure without encountering excessive chain cleavage, and is followed by an oxygen cross-linking reaction. The stabilized product exhibits improved physical properties. Carbonized or carbonized and graphitized fibrous materials may be formed upon heating the stabilized product in an inert atmosphere.

13 Claims, No Drawings

ACRYLIC FIBER CONVERSION UTILIZING A STABILIZATION TREATMENT CONDUCTED INITIALLY IN AN ESSENTIALLY INERT ATMOSPHERE

BACKGROUND OF INVENTION

In the past procedures have been proposed for the conversion of fibers formed from acrylic polymers to a modified form possessing enhanced thermal stability. Such modification has generally been accomplished by heating the fibrous material in an oxygen containing atmosphere, such as ordinary air, at moderate temperatures for extended periods of time. The resulting product may be suitable for use as an intermediate in the formation of carbonized fibrous materials, or for direct utilization as a fire resistant fiber. U.S. Pat. Nos. 2,913,802 to Barnett and 3,285,696 to Tsunoda disclose processes for the conversion of fibers of acrylonitrile homopolymers or copolymers to a heat resistant form. Such prior art stabilization techniques have commonly been directed to batch operations employing acrylonitrile copolymers. Belgian Pat. No. 700,655 discloses a procedure whereby a continuous length of an acrylonitrile copolymer may be continuously subjected to a preoxidation treatment to produce essentially complete oxygen saturation while maintained in air at a temperature not exceeding 250°C., e.g. three hours or more at 220°C. Belgian Pat. No. 678,679 and French Pat. No. 1,471,993 disclose conducting the complete stabilization process in an inert atmosphere.

The stabilization of fibers of acrylonitrile homopolymers and copolymers in an oxygen containing atmosphere involves (1) an oxidative cross-linking reaction of adjoining molecules as well as (2) a cyclization reaction of pendant nitrile groups to a condensed dihydropyridine structure. While the reaction mechanism is complex and not readily explainable, it is believed that these two reactions occur concurrently according to the prior art, or are to some extent competing reactions.

The cyclization reaction is exothermic in nature and must be controlled if the fibrous configuration of the acrylic polymer undergoing stabilization is to be preserved. As indicated, prior art techniques have commonly overcome this difficulty by heating the fiber at moderate temperatures generally extended over many hours.

It is an object of the invention to provide an improved process for the flame-proofing of fibrous materials formed from acrylic polymers.

It is an object of the invention to provide an improved process for the thermal stabilization of fibrous materials formed from acrylic polymers.

It is an object of the invention to provide non-burning stabilized acrylic fibrous materials which exhibit an enhanced molecular structure.

It is an object of the invention to provide a process for the production of stabilized acrylic fibrous materials which exhibit an unusually high modulus.

It is another object of the invention to provide an improved stabilization process for fibrous materials formed from acrylic polymers which results in a product which is suitable for carbonization, or carbonization and graphitization.

It is another object of the invention to provide a process for the stabilization of a fibrous material formed from an acrylic polymer which in at least some of its embodiments may be conducted on a highly expeditious continuous basis.

It is a further object of the invention to provide a stabilized lightweight fibrous material which is capable of end use applications in the aerospace industry, and in numerous other industrial areas.

It is a further object of the invention to provide a process for the efficient conversion of acrylic fibrous materials to a non-burning form which effectively overcomes the difficulty normally presented by the critical exotherm upon the subjection of such starting materials to heat.

It is a further object of the invention to provide a process for converting a fibrous acrylic material to a stabilized form possessing essentially the identical fibrous configuration as the starting material.

These and other objects, as well as the scope, nature and utilization of the invention will be apparent from the following detailed description and appended claims.

SUMMARY OF INVENTION

It has been found that an improved process for the stabilization of an acrylic fibrous material comprises heating a fibrous material consisting primarily of recurring acrylonitrile units in an essentially inert atmosphere until a cyclized product is formed in the absence of appreciable oxygen cross-linking which retains its original fibrous configuration essentially intact, and subsequently heating the cyclized product in an oxygen containing atmosphere until an oxygen cross-linked stabilized fibrous product capable of undergoing carbonization is formed which retains its original fibrous configuration essentially intact and which is non-burning when subjected to an ordinary match flame. The stabilized fibrous product exhibits enhanced physical properties, e.g. improved modulus.

DESCRIPTION OF PREFERRED EMBODIMENTS

It is observed that the oxidative cross-linking and the cyclization reactions referred to above which occur in the prior art when stabilization is conducted in an oxygen containing atmosphere commonly result in fragmentation of the polymer chains. It is further found by thermal gravimetric analyses that the thermal energy released during exposure of the acrylic precursor to an elevated temperature is greater in the presence of an oxygen containing atmosphere than if tested in an inert atmosphere. Such analyses additionally indicate a more rapid and larger weight loss when the cyclization reaction is conducted in an oxygen containing atmosphere.

It has now been established that if an acrylic precursor, discussed in detail hereafter, is initially subjected to an essentially inert atmosphere, i.e. a nonoxidative atmosphere, during a thermal stabilization treatment improved physical properties are exhibited by the stabilized fibrous product ultimately produced. It is accordingly believed that the initial step of the instant process facilitates the formation of longer lengths of naphthapyridine rings with diminished polymer chain fragmentation in the absence of interference resulting from the oxidation reaction. In the subsequent step of the stabilization treatment oxygen forms intermolecular cross-links which dimensionally stabilize the fibrous material containing the previously cyclized structure.

It is considered likely that cyclization results by initial proton transfer from the alpha or beta carbon to the nitrile group, and that propagation of the cyclization reaction results by proton transfer from the nitrile group to an adjacent nitrile group. The presence of appreciable oxygen during the cyclization reaction is believed to influence the initial proton transfer.

The acrylic fibrous material which is utilized as the starting material is formed either (1) entirely of recurring acrylonitirle units, or (2) of recurring acrylonitrile units copolymerized with a minor proportion of one or more monovinyl units to produce a copolymer exhibiting properties substantially similar to an acrylonitrile homopolymer. Acrylonitrile homopolymer materials are particularly preferred for use in the present process. Suitable copolymer materials commonly contain at least about 95 mol per cent of recurring acrylonitrile units and up to about 5 mol per cent of one or more monovinyl units copolymerized therewith. The preferred acrylonitrile copolymers contain at least about 99 mol per cent of acrylonitrile units and up to about 1 mol per cent of one or more monovinyl units copolymerized therewith. Suitable monovinyl units include styrene, methyl acrylate, methyl methacrylate, vinyl acetate, vinyl chloride, vinylidene chloride, vinyl pyridine, and the like, or a plurality of such monomers.

The acrylic fibrous materials which are stabilized in accordance with the present invention may be present in any one of a variety of configurations. For instance, the fibrous materials may be present in the form of continuous single filaments, stable fibers, tows, yarns, ropes, tapes, knits, braids, fabrics, or other fibrous assemblages. In a preferred embodiment of the invention the fibrous material is present in a continuous length, e.g. a single continuous filament, a yarn, or a tape. In a particularly preferred embodiment of the invention the acrylic fibrous material is in the form of a continuous filament yarn. Such a yarn may be formed by conventional techniques which are well known to those skilled in the art. For instance, dry spinning or wet spinning techniques may be employed. The yarn which serves as the starting material in the process may optionally be provided with a twist which improves its handling characteristics. For example, a twist of about 0.1 to 1 tpi, and preferably about 0.1 to 0.7 tpi may be utilized. Yarns or other fibrous assemblages may generally be formed (1) prior to the stabilization treatment, (2) between the stabilization stages of the process, or (3) immediately subsequent to the stabilization treatment.

The acrylic fibrous material which serves as the starting material may be highly oriented. For instance, the starting material may be highly oriented by hot drawing to a relatively high single filament tensile strength of at least about 5 grams per denier prior to stabilization. Fibrous starting materials which possess a single filament strength of about 7.5 to 8 grams per denier are commonly selected for use in the process.

When a highly oriented continuous length of acrylic fibrous material having a single filament tensile strength of at least about 5 grams per denier is stabilized in accordance with the present invention on a continuous basis, the fibrous material is maintained throughout the heat treatment under conditions whereby appreciable shrinkage may occur in accordance with the teachings of U.S. Ser. No. 750,018, now abandoned, of Michael J. Ram and Richard N. Rulison, filed Aug. 5, 1968, which is assigned to the same assignee as the instant invention and is hereby incorporated by reference.

The cyclization reaction involving pendant nitrile groups which occurs upon exposure of the acrylic fibrous materials to heat is exothermic whether conducted in an inert or in an oxygen containing atmosphere and if uncontrolled may result in the destruction of the fibrous configuration of the starting material. In some instances this exothermic reaction will occur with explosive violence. More commonly, however, the fibrous material will simply rupture, disintegrate and/or coalesce when the critical temperature is reached. As the quantity of comonomer present in an acrylonitrile copolymer is increased, a fibrous material consisting of the same tends to soften at a progressively lower temperature and the possible destruction of the original fibrous configuration through coalescence of adjoining fibers becomes a factor of increasing importance. Such softening is generally accompanied by a marked reduction in strength which may in severe instances lead to the destruction of the original fibrous configuration through breakage brought about by the inability of the fibrous material to support its own weight. Also, fibrous materials which are highly oriented tend to exhibit a higher critical temperature than the corresponding materials which lack such orientation. The "critical temperature" referred to herein is defined as the temperature at which the fibrous configuration of a given sample of acrylic fibrous starting material will be destroyed in the absence of prior stabilization.

In a preferred embodiment of the invention the starting material exhibits a critical temperature of at least about 275°C., e.g. about 300°C. to 330°C. In addition to visual observation, the detection of the critical temperature of a given acrylic material may be aided in some instances by the use of thermoanalytical methods, such as differential scanning calorimeter techniques, whereby the location and magnitude of the exothermic reaction can be measured quantitatively. Such methods are particularly useful when the acrylic material is an acrylonitrile homopolymer.

Once the cyclization reaction is begun in the absence of a provision for heat dissipation the critical temperature may be rapidly approached or even exceeded with the concomitant destruction of the product. It accordingly follows that if one chooses to stabilize a package of yarn in accordance with the present invention where heat dissipation is possibly impaired within the interior thereof, and where portions of the fibrous material are in contact, the initial heat applied to the same and the heating rate must be relatively moderate so that the exothermic heat of reaction generated within the package as the cyclization reaction progresses does not exceed the threshold temperature for any portion of the package. For batch commercial production when long continuous lengths of product are required, extremely large supports or bobbins are necessary for the starting material since the package thickness which may be tolerated is generally thin.

For best results uniform heat treatment throughout all portions of the fibrous acrylic material during the stabilization treatment, and particularly during the initial stage thereof, is encouraged. Such uniform reaction conditions can best be accomplished by limiting the mass of fibrous material at any one location so that heat dissipation from within the interior of the material is not unduly impaired. For instance, the fibrous material undergoing treatment may be heated with generally free access to an appreciable portion of its surface area being provided. In a preferred embodiment of the invention a continuous length of the acrylic starting material, such as a yarn, is continuously passed through suitable heating zones while suspended in the same. Also, the fibrous material may be present as previously indicated as windings on a support during the stabilization treatment provided means are available for the effective dissipation of heat generated within the windings, such as circulating fans. When a batch stabilization procedure is utilized, the fibrous material may first be passed through a liquid medium containing a dispersion of particulate carbon and dried prior to stabilization. Such preliminary treatment diminishes the stickiness of adjoining fibers during the stabilization and may be conducted in accordance with the teachings of U.S. Ser. No. 700,672, filed Jan. 12, 1968 (now U.S. Pat. No. 3,508,874), of Richard N. Rulison, which is assigned to the same assignee as the instant invention and is hereby incorporated by reference.

During the initial stage of the stabilization procedure the acrylic fibrous material is heated in an essentially inert atmosphere until a cyclized product is formed in the absence of appreciable oxygen cross-linking which retains its original configuration essentially intact. The initial stage is preferably conducted in the total absence of oxygen. Relatively minor amounts of oxygen, e.g. up to one per cent by weight, may be present however, provided the quantity present does not result in a significant degree of intermolecular oxygen cross-linking which interfers with the cyclization reaction. Suitable inert atmospheres include nitrogen, helium and argon. The particularly preferred inert atmosphere is nitrogen.

The time required to complete the initial stage of the stabilization reaction is inversely related, but not necessarily proportional to the temperature to which the fibrous material is subjected. For instance, if the treatment is conducted at a temperature of about 200°C. to 270°C., heating times commonly range from about 70 hours to 30 minutes. At the completion of the initial stage of the process the fibrous material may range in color from a deep red-brown to black and is flammable when subjected to an ordinary match flame. If a relatively severe heating temperature, e.g. 270°C., is utilized the material will tend to be black in appearance, while if a more moderate temperature, e.g. 200°C., is utilized the material will tend to be a deep red-brown color. Throughout the initial stage of the process the cyclization reaction progresses to a high degree of completion without undue polymer chain cleavage. One may determine that the cyclization reaction has reached the desired degree of completion by visual observation as the material is transformed from white to a deep shade of red-brown or black.

The subsequent heating stage of the stabilization treatment is conducted in an oxygen containing atmosphere until an oxygen cross-linked stabilized fibrous product capable of undergoing carbonization is formed which retains its original fibrous configuration essentially intact and which is non-burning when subjected to an ordinary match flame. The oxygen containing atmosphere contains an appreciable quantity of oxygen, e.g. about 5 to 100 per cent by weight, and preferably about 5 to 30 per cent by weight. Ordinary air may be utilized. At the termination of the subsequent stage of the process the fibrous material is black in appearance.

The subsequent heating stage of the stabilization procedure may be carried out (1) at a temperature below that utilized in the initial stage, (2) at the identical temperature utilized in the initial stage, or (3) at a temperature in excess of that utilized in the initial stage. The time required to complete the subsequent stage of the process is inversely related, but not necessarily proportional to temperature. For instance, if the subsequent stage is conducted at a temperature of about 180°C. to 325°C., heating times commonly range from 40 hours to 15 minutes. While the lower temperatures require greater reaction times, it is believed that lesser polymer chain cleavage accompanies the use of the same.

A total bound oxygen content of at least about 7 per cent by weight is achieved during the subsequent stage of the process. A bound oxygen content of 7 to 15 per cent by weight is commonly produced during the treatment. Higher oxygen contents tend to require extended residence times. The weight percentage of bound oxygen present in the material may be determined by routine analytical techniques, such as the Unterzaucher analysis.

The stabilization treatment of the present invention yields a stabilized fibrous material which may be carbonized or carbonized and graphitized in an inert atmosphere. Carbonization temperatures ranging from about 900°C. to 3000°C. may be employed for about 3 seconds to about 5 minutes. The carbonization step may generally follow immediately after the multiple stage stabilization treatment previously described without the necessity to use an intermediate heating schedule. During the carbonization reaction elements present in the stabilized fibrous material other than carbon, e.g. nitrogen, hydrogen and oxygen, are expelled. The term "carbonized product" as used herein is defined to be a product consisting of at least about 90 per cent carbon by weight, and preferably at least about 95 per cent carbon by weight. Graphitic carbon may or may not be present in the same. Suitable inert atmospheres in which the carbonization step may be conducted include nitrogen, argon, helium, etc.

A carbonized product including substantial amounts of graphitic carbon results if the temperature is more severe, e.g. about 2000°C. to about 3000°C. Essentially complete graphitization of the carbonized product may generally be accomplished in about 5 seconds to about 2 minutes which may be detected by the characteristic x-ray diffraction pattern of graphite. In a particularly preferred embodiment of the invention a graphitized product is formed by heating the carbonized fibrous material at a temperature of about 2900°C. for at least about 5 seconds, e.g. about 5 to 60 seconds. By varying the temperature the properties of the resulting product may be varied. For instance, the modulus of the carbonized product tends to increase with increasing temperature, while the tensile strength tends to remain constant for all temperatures above about 1400°C. provided the fiber is not damaged by handling or thermal shock.

The equipment utilized to carry out the process of the invention may be varied widely as will be apparent to those skilled in the art. For instance, during the stabilization reactions the fibrous material may be placed in or continuously passed through a circulating oven, or the tube of a muffle furnace while in contact with the requisite atmosphere. The material may be consecutively placed in a series of such ovens or furnaces each provided with the proper atmosphere. In a continuous operation a continuous length of the fibrous material may be optionally passed through a given zone for a plurality of passes until the desired residence time at each stage of the process is achieved.

The carbonization or carbonization and graphitization treatment may be conducted in any apparatus capable of producing the required temperatures while excluding the presence of an oxidizing atmosphere. For instance, suitable apparatus include an induction furnace, arc furnace, solar furnace, low temperature plasma flame, etc. When an induction furnace of the Lepel type is utilized, the stabilized fibrous material may be passed through a graphite tube or shroud which is situated within the windings of an induction coil. Also, the fibrous material may be passed through a hollow graphite resistance tube which is provided with suitable electrodes, or alternatively heated by direct resistance techniques.

The following examples are given as specific illustrations of the invention. It should be understood, however, that the invention is not limited to the specific details set forth in the examples.

EXAMPLE I

With Stabilization Treatment of the Invention

A continuous length of an 800 fil dry spun acrylonitrile homopolymer continuous filament yarn having a total denier of 1120 was selected as the starting material. The yarn was highly oriented and drawn to a single filament tenacity of 8.08 grams per denier.

Thirty meters of the yarn were continuously passed through a vessel containing a 4 per cent by weight aqueous dispersion of colloidal graphite for an immersion time of about 1.5 seconds. Excess dispersion was removed by passing the saturated yarn upwardly through a series of five ceramic pins. Thereafter the wet impregnated yarn was passed over (10 wraps) a steam heated drying roll having a surface heated within the range of about 105°C. to 110°C. The dried yarn was then wound by the aid of a Leesona winder on a 3 inch diameter aluminum bobbin under 80 grams tension.

The dried yarn while present on the bobbin was placed in an Aminco high temperature oven provided with an essentially pure nitrogen atmosphere maintained at 225°C. The yarn was maintained in the nitrogen atmosphere for 2 hours at 225°C. The temperature within the oven was next raised to 325°C. at the rate of 0.25°C. per minute. When the temperature had reached approximately 285°C., the essentially pure nitrogen atmosphere was replaced by a 20 per cent oxygen atmosphere. After the yarn had remained within the oxygen containing atmosphere for 15 minutes at 325°C. it was removed and observed to be black in appearance, non-burning when subjected to an ordinary match flame, not coalesced, readily flexible, and exhibited no residual exotherm. Upon physical testing the stabilized yarn was found to possess a single filament tenacity of 1.73 grams per denier, a single filament modulus of 93.9 grams per denier, a bound oxygen content of 14.6 per cent by weight, and a specific gravity of 1.61.

The stabilized yarn was next continuously introduced and withdrawn from a Lepel 450 KC induction furnace in order to carbonize and graphitize the same where it was heated to a maximum temperature of approximately 2900°C. for a total residence time of 40 seconds. The induction furnace comprised a 10 turn water cooled copper coil having an inner diameter of ¾ inch and a length of 2 inches, a 20 KW power source, and was equipped with a hollow graphite tube suspended within the coil of the same having a length of 8½ inches, an outer diameter of ½ inch and an inner diameter of ⅛ inch through which the previously stabilized yarn was continuously passed. The copper coil which encompassed a portion of the hollow graphite tube was positioned at a location essentially equidistant from the respective ends of the graphite tube. An inert atmosphere of nitrogen was maintained within the induction furnace.

EXAMPLE II

With Stabilization Treatment of the Invention

Example I was repeated subject to the modifications indicated employing an identical yarn sample.

The dried yarn while present on an aluminum bobbin was heated in an essentially pure nitrogen atmosphere for 16 hours at 225°C. The temperature within the oven was next raised to 270°C. at a rate of 0.25°C. per minute. The essentially pure nitrogen atmosphere was maintained at 270°C. for 2½ hours and was then replaced by a 20 per cent oxygen atmosphere for an additional 30 minutes at 270°C. The appearance of the stabilized yarn was identical to that produced in Example I.

The stabilized yarn upon physical testing was found to possess a single filament tenacity of 2.44 grams per denier, a single filament modulus of 111 grams per denier, a bound oxygen content of 10.6 per cent by weight, and a specific gravity of 1.47.

EXAMPLE III

With Stabilization Treatment of the Invention

Example I was repeated subject to the modifications indicated employing an identical yarn sample.

The dried yarn while present on an aluminum bobbin was heated in an essentially pure nitrogen atmosphere for 2 hours at 225°C. The temperature within the oven was next raised to 270°C. at the rate of 2°C. per minute. When the temperature had reached approximately 240°C., the essentially pure nitrogen atmosphere was replaced by a 55 per cent oxygen atmosphere. The yarn remained in the oxygen containing atmosphere for 15 minutes at 270°C. The appearance of the stabilized yarn was identical to that produced in Example I.

The stabilized yarn upon physical testing was found to possess a single filament tenacity of 1.58 grams per denier, a single filament modulus of 120 grams per denier, a bound oxygen content of 13.0 per cent by weight, and a specific gravity of 1.47.

With Stabilization Treatment Exclusively in Inert Atmosphere

Example III was repeated employing the same time-temperature schedule with the exception that the entire stabilization procedure was conducted in an essentially pure nitrogen atmosphere. The stabilized yarn was reddish-brown in appearance compared with the black product of Example III, and was so exceedingly weak and brittle that tenacity and modulus values could not be determined.

With Stabilization Treatment Exclusively in Oxidative Atmosphere

A standard batch stabilization process was conducted utilizing yarn samples identical to those employed in the preceding examples. The yarn was placed on a three inch diameter aluminum bobbin and was heated in air for 16 hours at 200°C., the temperature was gradually raised to 270°C. in 1 hour, and maintained at 270°C. for 1 hour.

Upon physical testing the stabilized yarn exhibited a single filament tenacity of 1.5 grams per denier, a single filament modulus of 80 grams per denier, a bound oxygen content of 12.5 per cent by weight, and a specific gravity of 1.5.

It is accordingly observed that the tenacities of stabilized yarns formed according to the present invention are equal to or greater than those obtained in the standard batch process, and that the moduli of stabilized yarns formed according to the present invention are greater than those obtained with the standard.

Example IV

With Continuous Stabilization Treatment of the Invention

A continuous length of acrylonitrile homopolymer yarn identical to that utilized in the preceding examples with the exception that it lacks the colloidal graphite treatment is continuously stabilized according to the following procedure.

The yarn is continuously introduced and suspended within an oven containing a nitrogen atmosphere maintained at 220°C. where its movement is directed by rollers located within the same. After a residence time of 240 minutes, the yarn is continuously withdrawn and continuously introduced into a similar oven maintained at 275°C. containing air. After a residence time of 30 minutes, a stabilized yarn of superior tenacity and modulus is continuously withdrawn. The stabilized yarn is non-burning when subjected to an ordinary match flame and retains its original fibrous configuration essentially intact. The stabilized yarn is next carbonized and graphitized in accordance with the procedure of Example I.

The fibrous material resulting from the stabilization treatment of the present invention is suitable for use in applications where a fire resistant fibrous material is required. For instance, non-burning fabrics may be formed from the same. As previously indicated, the stabilized fibrous materials are particularly suited for use as intermediates in the production of fibrous graphite products. Such fibrous graphite products may be incorporated in a binder or matrix and serve as a reinforcing medium. The graphite component may accordingly serve as a light weight load bearing component in high performance structures which find particular utility in the aerospace industry. High strength pressure vessels, compressor turbine blades, and numerous other articles may be formed from such materials.

Although the invention has been described with preferred embodiments, it is to be understood that variations and modifications may be resorted to as will be apparent to those skilled in the art. Such variations and modifications are to be considered within the purview and scope of the claims appended hereto.

I claim:

1. A process for the stabilization of an acrylic fibrous material comprising heating a fibrous material consisting primarily of recurring acrylonitrile units in an essentially inert atmosphere at a temperature of about 200°C. to 270°C. until a cyclized product is formed in the absence of appreciable oxygen cross-linking which retains its original fibrous configuration essentially intact, and subsequently heating said cyclized product in an oxygen-containing atmosphere at a temperature of about 180°C. to 325°C. until an oxygen cross-linked stabilized fibrous product capable of undergoing carbonization is formed which retains its original fibrous configuration essentially intact and which is non-burning when subjected to an ordinary match flame.

2. A process according to claim 1 in which said acrylic fibrous material is an acrylonitrile homopolymer.

3. A process according to claim 1 in which said acrylic fibrous material is an acrylonitrile copolymer which contains at least about 95 mol per cent of acrylonitrile units and up to about 5 mol per cent of one or more monovinyl units copolymerized therewith.

4. A process according to claim 1 in which said acrylic fibrous material possesses a single filament tenacity of at least about 5 grams per denier prior to stabilization.

5. A process according to claim 1 in which said inert atmosphere is selected from the group consisting of essentially pure nitrogen, helium, and argon.

6. A process according to claim 1 in which said oxygen containing atmosphere is air.

7. A process according to claim 1 in which said acrylic fibrous material is a yarn.

8. A process according to claim 1 in which said acrylic fibrous material is heated in said essentially inert atmosphere at a temperature of about 200°C. to 270°C. for about 70 hours to 30 minutes, and in said oxygen containing atmosphere at a temperature of about 180°C. to 325°C. for about 40 hours to 15 minutes.

9. A process for the stabilization of a continuous length of a fibrous material consisting of an acrylonitrile homopolymer comprising continuously passing said material through an essentially inert atmosphere maintained at a temperature of about 200°C. to 270°C. until a cyclized product is formed in the absence of appreciable oxygen cross-linking which retains its original fibrous configuration essentially intact, and subsequently continuously passing said cyclized product through an oxygen-containing atmosphere maintained at a temperature of about 180°C. to 325°C. until an oxygen cross-linked stabilized fibrous product capable of undergoing carbonization is formed which retains its original fibrous configuration essentially intact and which is non-burning when subjected to an ordinary match flame.

10. A process according to claim 9 in which said continuous length of an acrylonitrile homopolymer is a continuous filament yarn.

11. A process according to claim 9 in which said inert atmosphere is selected from the group consisting of essentially pure nitrogen, helium, and argon.

12. A process according to claim 9 in which said oxygen containing atmosphere is air.

13. A process according to claim 9 wherein said continuous length of acrylonitrile homopolymer fibrous material is continuously passed through said inert atmosphere and said oxygen containing atmosphere in the direction of its length.

* * * * *